United States Patent [19]

Bull et al.

[11] Patent Number: 4,916,454

[45] Date of Patent: Apr. 10, 1990

[54] ADAPTIVE NULLING CIRCULAR ARRAY ANTENNA

[75] Inventors: Jeffrey F. Bull, Warrington; Richard P. Flam, Doylestown, both of Pa.

[73] Assignee: Allied-Signal Inc., Morristown, N.J.

[21] Appl. No.: 361,851

[22] Filed: Jun. 5, 1989

[51] Int. Cl.[4] ..... H01Q 3/22; H01Q 3/24; H01Q 3/26

[52] U.S. Cl. ..... 342/373; 342/372

[58] Field of Search ..... 342/373, 372

[56] References Cited

U.S. PATENT DOCUMENTS 4,178,581 12/1979 Willey, Sr. .
4,316,192 2/1982 Acoraci .
4,425,567 1/1984 Tresselt .
4,628,321 12/1986 Martin ..... 342/379
4,825,213 4/1989 Smrek ..... 342/25

OTHER PUBLICATIONS

B. Sheleg, "A Matrix-Fed Circular Array for Continuous Scanning", Proc. IEEE, Nov. 1968, pp. 2016–2027.

*Primary Examiner*—Theodore M. Blum
*Attorney, Agent, or Firm*—Howard G. Massung; Robert A. Walsh

[57] ABSTRACT

A method of operating a circular array antenna, Butler matrix, phase shifters and beam forming network is described including a control circuit or computer algorithm for modifying the phase of the phase shifters, one at a time, and measuring the output power received or transmitted by the circular array antenna to estimate the gradient of the output power. The invention overcomes the problem of nulling out interfering signals by modifying the beam pattern of the antenna in certain directions while maintaining the beam pattern in preferred directions for receiving desired signals.

4 Claims, 2 Drawing Sheets

ADAPTIVE NULLING CIRCULAR ARRAY ANTENNA

BACKGROUND OF THE INVENTION

1. Field of the Invention

This invention relates to adaptive nulling in the antenna pattern in a circular array antenna and more particularly to modifying an antenna pattern of a circular antenna array to create nulls in the direction of interfering signal sources.

2. Description of the Prior Art

Multimode circular antennas possess the useful property that their main beam may be scanned by application of a linear phase shift across their mode inputs. Unlike linear arrays, their beam does not broaden with scan angle, but maintains its shape independent of scan angle. Electronically scanned circular antennas have enjoyed widespread application since they may be quickly scanned through the use of pin diode phase shifters.

In U.S. Pat. No. 4,425,567 which issued on Jan. 10, 1984, to C. P. Tresselt, a beam forming network 62 is described coupled through phase shifters 60 to a Butler matrix as shown in FIG. 3 of '567. The outputs of the Butler matrix 58 are coupled through respective elevation pattern beam forming networks to eight vertical columns, each having eight dipole antenna elements, each vertical column equally spaced around a conducting cylinder which forms a ground plane. The beam forming network 62 in '567 generates sum and difference antenna patterns having omnidirectional side lobes. Phase shifters 60 are controlled by the steering circuitry 64 which supplies the seven phase shifters with appropriate 6-bit words for steering the antenna pattern to each of 64 beam positions around the circular antenna array 50.

In U.S. Pat. No. 4,316,192, which issued on Feb. 16, 1982, to J. H. Acoraci, a beam forming network 62 is described for generating a sum and difference pattern. The beam forming network is shown coupled to a circular array antenna through phase shifters 60 and a Butler matrix 58. FIG. 2 of '192 shows that a difference pattern from the beam forming network of FIG. 7 may be formed in hardware by subtracting a sum pattern from an omnidirectional pattern to form a cardioid which in turn was added to a difference pattern to form a difference pattern with omnidirectional side lobes. Beam forming network 62 provides a sum and difference pattern which is steered around circular multimode antenna array 50 by steering circuit 64 which supplies control signals to phase shifters 60.

A publication by B. Sheleg entitled "A Matrix-Fed Circular Array for Continuous Scanning", Proc. IEEE, November 1968, pp. 2016–2027 describes and shows in FIG. 2 thereof a Butler matrix fed electronically scanned circular array.

In U.S. Pat. No. 4,178,581, which issued on Dec. 11, 1979, to R. E. Willey, Sr., a phased array antenna is shown having individual antenna elements coupled through phase shifters to a power distribution network. The phase shifters are first set by a beam steering control unit to form a narrow beam. By applying spoiling phases to the phase shifters of the array the narrow beam may be broadened substantially, for example, from three degrees beam width to eighty-eight degrees beam width, as shown in FIG. 7. Computation of spoiling phases to provide particular patterns for particular phased array antennas is disclosed.

SUMMARY OF THE INVENTION

A method is described for modifying an antenna pattern of a circular antenna array connected through a Butler matrix and phase shifters to a beam forming network to create nulls in the directions of interfering signal sources comprising the steps of receiving an interfering signal at the output of the beam forming network, varying the phase of each phase shifter connected to a respective mode port of the Butler matrix, one at a time, in a first phase direction and measuring the respective output power of the beam forming network, estimating the gradient of the output power $\nabla P$ where $\nabla ZP$ is $\partial P/\partial \phi_i(k)$ where i is the phase shifter and (k) is the interation number, and setting the phase of each phase shifter in response to the gradient of the output power.

It is an object of the invention to iteratively minimize an objective function which includes a measure of the output power of the antenna and a penalty function that effectuates a main beam constraint.

It is a further object of the invention to determine the gradient of an objective function by "dithering" the phase of each phase shifter individually up and down in phase while monitoring the output power or the received power of the antenna.

It is a further object of the invention to determine the gradient of the penalty function by analytial means.

It is a further object of the invention to adjust only the phase of phase shifters in a mode fed circular array antenna to create a null in the antenna pattern. By using the Butler matrix between the phase shifters and the circular array antenna, the phase shift technique is lossless with respect to RF power fed to the circular array antenna.

It is a further object of the invention to provide a lossless side lobe cancellor by adjusting the phase of the phase shifters in a mode fed circular array antenna to create appropriate nulls at desired directions.

DESCRIPTION OF THE PREFERRED EMBODIMENT

Figure 1:
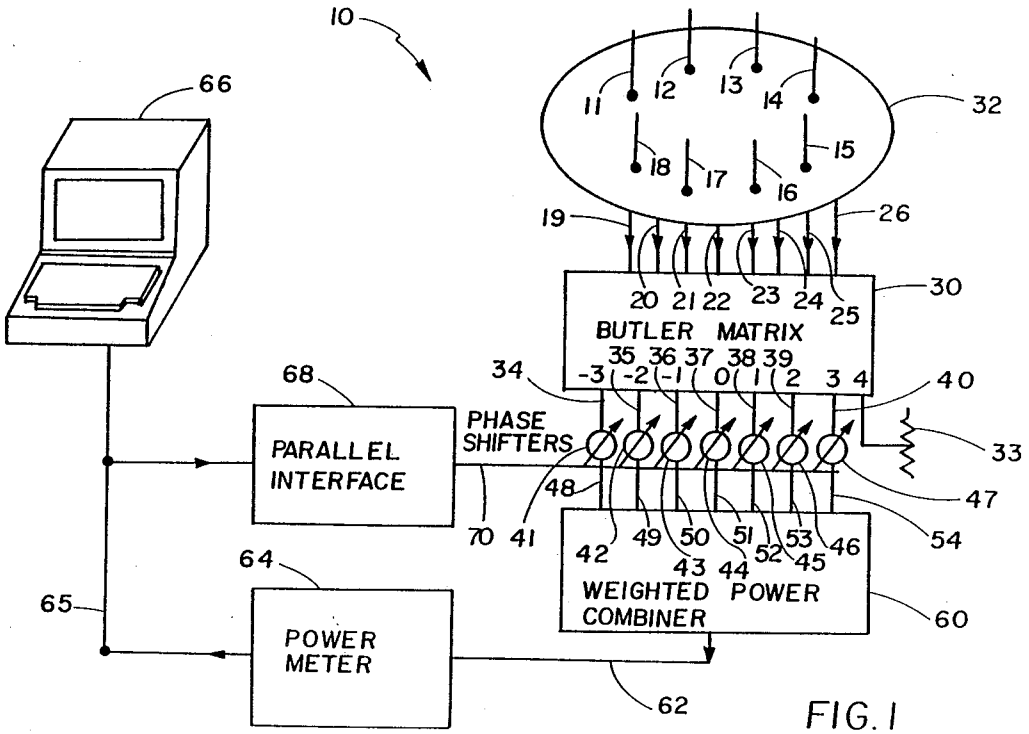
FIG. 1 is a block diagram of a multimode circular array antenna.

Referring to FIG. 1, a multimode circular array antenna 10 is shown comprising antenna elements 11–18 positioned in a circle to radiate outwards from the circle of antenna elements. Antenna elements 11–18 are coupled over leads 19–26 to respective inputs of Butler matrix 30. Antenna elements 11–18 may be, for example, mounted on a ground plane 32 which may be a disc or flat plate or shaped to form a cylinder. Butler matrix 30 has eight modes, −3 to +4. Mode 4 is terminated by resistor 33. Modes −3 to +3 are coupled over leads 34–40 through respective phase shifters 41–47 and over leads 48–54 to respective inputs of beam forming network or weighted power combiner 60. Weighted power combiner 60 functions to provide a weight to form an antenna beam pattern which may be, for example, a sum and difference beam pattern. The output of weighted power combiner 60 is coupled over lead 62 to an input of power meter 64 which may be, for example, model 436A RF power meter manufactured by the Hewlett-Packard Company, Palo Alto, Calif. The output of power meter 64 is coupled over lead 65 which may be, for example, a bus corresponding to the specifications IEEE 488 to a computer 66 which may be, for example, a Hewlett-Packard Vectra Desktop Computer manufactured by the Hewlett-Packard Company, Palo Alto, Calif. The computer has a stored program for carrying out the steps of the invention. An output of computer 66 is coupled over lead 65 to an input of parallel interface 68 having outputs coupled respectively to the control inputs of phase shifters 41–47 for controlling the phase shift of each phase shifter. As shown in FIG. 1, computer 66 may generate phase shift control signals to phase shifters 41–47 and receive the radio frequency power output of multimode circular array antenna 10 over lead 62. Power meter 64 measures the power received on lead 62 and couples a signal indicative of power over lead 65 to computer 66.

In FIG. 1, the diameter of the circle upon which antenna elements 11–18 are placed may be, for example, 0.95 wavelength with respect to the radio frequency or microwave carrier being radiated. The 8×8 Butler matrix 30 provides a transformation on the antenna signals similar to a Discrete Fourier Transformation. The outputs of Butler matrix 30, designated modes 0, ±1, ±2, and ±3 are connected to seven 6-bit phase shifters 41–47. Mode 4 is terminated by resistor 33. The phase of each phase shifter is individually controlled and can be set to anyone of 64 states by respective signals over lead 70. The outputs of phase shifters 41–47 are weighted and combined in beam forming network or weighted power combiner 60. The weights of the combiner are chosen to provide a specified quiescent pattern.

A "phase only" gradient-based adaptive algorithm is described for interference nulling with the multimode circular array antenna 10 as shown in FIG. 1. The objective of the algorithm is to minimize the output power of multimode circular array antenna 10 while maintaining the direction of the main beam. This is accomplished by iteratively minimizing an objective function based upon its gradient The objective function consists of two components: a measure of the output power of the antenna and a penalty function that effectuates a main beam constraint. The gradient of the objective function, therefore, consists of two components. The gradient of the output power is obtained by "dithering" or varying the phase of each phase shifter individually while monitoring the output power. The gradient of the penalty function is obtained analytically. The following paragraphs develop the algorithm mathematically by first neglecting the penalty function in the derivation and later including it.

The gradient search algorithm provides an iterative technique to determine the solution vector that minimizes a multidimensional objective function provided it possesses a global minimum and does not have local minima or inflection points. We begin development of the "phase only" adaptive nulling algorithm by stating that, at least initially, our objective function is the antenna output power and the variables are the phases of the phase shifters 41–47 at the mode ports of Butler matrix 30. We assume that our objective function possesses a global minimum. The algorithm is written as shown in equation 1

$$\phi(k+1)=\phi(k)-ui\nabla P \quad (1)$$

where P is the antenna's 10 output power, $\phi(k)$ is the vector of phase shifter phases at iteration k and $U_1$ is a scalar constant that controls the step size or transient response. An estimate of the gradient of the output power, $\nabla P$, is obtained by individually "dithering" each phase shifter up and down by a specified amount, measuring the power each time, and computing the slope of the power function. The estimate is shown in equation 2

$$\partial P/\partial\phi_i(k)=\}P(\phi_i(k)+\Delta\phi)-P(\phi_i(k)-\Delta\phi)\}/2\Delta\phi \quad (2)$$

where $\Delta\phi$ is the phase step taken above and below the nominal phase. Since the gradient points in the direction of maximum rate of change of a function, the negative sign is used in the algorithm to point toward the minimum.

The algorithm described by Equation (1) will steer nulls in the antenna's 10 pattern in the direction of incident signals independent of their angle-of-arrival, provided it has ufficient degrees of freedom. Typically, the main beam is pointed in the direction of a desired signal and, therefore, should not be nulled. In order to protect the desired signal from being nulled, we must modify the algorithm to incoporate a main beam constraint. This is accomplished by including a penalty function within the objective function to be minimized. Consider a steering vector, $\phi s$, applied at the mode ports of the antenna to steer the beam to a desired direction. A penalty function, F, may be defined as the squared deviation of the phase vector, at any iteration number k, from the steering vector $\phi s$. Mathematically, this is written as shown in equation 3

$$F=[\phi(k)-\phi S]^T[\phi(k)-\phi S] \quad (3)$$

The algorithm is updated to include the penalty function as shown in equation 4

$$\phi(k+1)=\phi(k)-u1\nabla P-u2\nabla F \quad (4)$$

where $U_2$ is a scalar representing the step size for the penalty function. The gradient of the penalty function, $\nabla F$, is expressed analytically as shown in equation 5

$$\nabla F=2[\phi(k)-\phi S] \quad (5)$$

The a1gorithm is now recast in its final form as in equation 6

$$\phi(k+1)=\phi(k)-u1\nabla P-u2[\phi(k)-\phi s] \quad (6)$$

where the factor of two in the gradient of the penalty function has been absorbed in the step size U.

The "phase only" adaptive nulling scheme was simulated on a computer with good results. Next, an experimental setup was constructed to test the scheme with available hardware on an antenna range. FIG. 1 illustrates the test setup in the control building at the outdoor antenna range. A HP Vectra desktop computer 66 acts as a non-real-time adaptive processor for the experiment. It controls the seven, 6-bit phase shifters 41–47 via an IEEE 488 interface and lead 70. A HP 436A RF power meter 64 is connected to the output of the antenna array 10 on lead 62 to measure the output power. Power meter 64 also communicates to the Vectra computer 66 over the IEEE 488 bus, lead 65.

Figure 2:
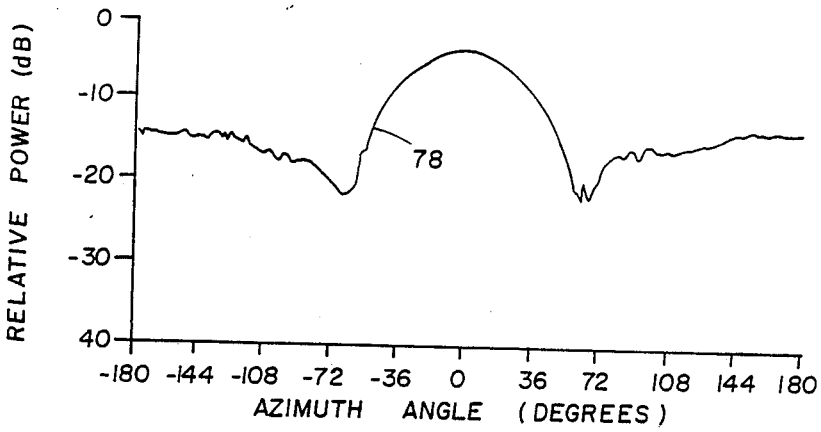
FIG. 2 is a graph showing a quiescent antenna pattern.
Figure 3:
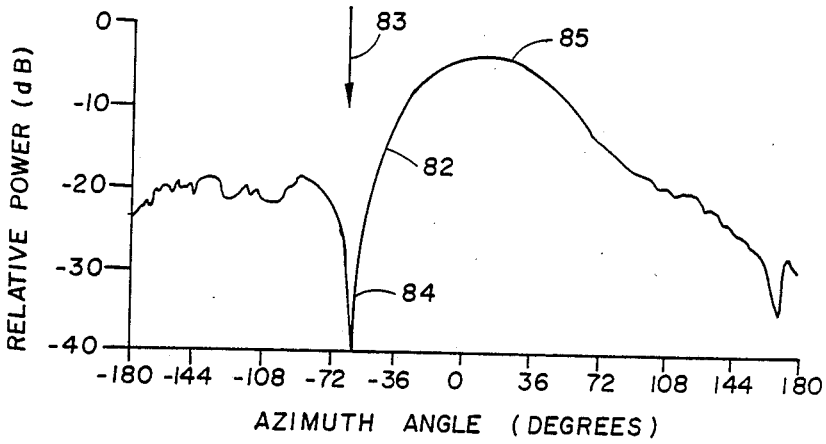
FIG. 3 is a graph showing an adapted antenna pattern.

In operation, the main beam of antenna 10 is steered to 0 degrees and the antenna pattern measured. FIG. 2 illustrates the measured quiescent pattern as shown by curve 78. In FIG. 2 the ordinate represents relative power in decibels and the abcissa represents azimuth angle in degrees. Next, the antenna array 10 is illuminated with a signal at an azimuthal incidence angle of −60 degrees. The adaptive processor 66 is started and after convergence the phase shifter states of phase shifters 41–47 are frozen. The antenna pattern is once again measured and is illustrated in FIG. 3 by curve 82. In FIG. 3 the ordinate represents relative power in decibels and the abcissa represents azimuth angle in degrees. The deep null steered in the direction of the incident signal is shown at arrow 83 and by curve portion 84 and that the main beam shown by curve portion 85 maintains its shape, verifying that the invention performs as expected.

A novel, "phase-only" adaptive nulling algorithm has been developed as an "applique" for a multimode circular antenna 10. This technique allows the antenna 10 to be used in transmit mode as well as for the reception mode since the nulling technique does not introduce ohmic loss into the beam forming network or weighted power combiner 60. The technique has been verified through the computer simulation and brief experimentation.

What is claimed:

1. A method for modifying an antenna pattern of a circular array antenna connected through a Butler matrix and phase shifters to a beam forming network to create nulls in the directions of interfering signal sources comprising the steps of:

receiving an interfering signal at the outputs of said beam forming network, varying the phase of each phase shifter connected to a respective mode port of the Butler matrix, one at a time, in a first phase direction and measuring the respective output power of said beam forming network, estimating the gradient of the output power $\nabla P$ where $\nabla P$ is $\partial P/\partial \phi_i(k)$ where i is the phase shifter and (k) is the iteration number, and setting the phase of each phase shifter in response to the gradient of the output power.

2. The method of claim 1, wherein said step of estimating includes the step of including gradient of a penalty function to provide a main beam constraint.

3. The method of claim 1, wherein said step of estimating includes the step of including $2[\phi(k)-\phi s]$ as the gradient of a penalty function to provide a main beam constraint where $\phi k$ is the vector of phase shifter phases and $\phi s$ is the steering vector.

4. A method for modifying an antenna pattern of a circular array antenna connected through a Butler matrix and phase shiftes to a beam forming network to create nulls in the directions of interfering signal sources comprising the steps of:

receiving an interfering signal at the outputs of said beam forming network, varying the phase of each phase shifter connected to a respective mode port of the Butler matrix, one at a time, in a first phase direction and measuring the respective output power of said beam forming network, estimating the new vector of phase shifter phases $\phi(k+1)$ according to $\phi(k)-u1\nabla P-u2[\phi(k)-\phi s]$ where $\nabla P$ is $\partial P/\partial \phi_i(k)$ where i is the phase shifter and (k) is the iteration number, $\phi k$ is the vector of phase shifter phases, $\phi s$ is the steering vector and $U_1$ and $U_2$ are scalar numbers, and setting the phase of each phase shifter in response to the new vector of phase shifter phases $\phi(k+1)$.

* * * * *